US009496599B1

(12) United States Patent
Huang et al.

(10) Patent No.: US 9,496,599 B1
(45) Date of Patent: Nov. 15, 2016

(54) COMMUNICATION DEVICE

(71) Applicant: AUDEN TECHNO CORP., Taoyuan County (TW)

(72) Inventors: Yu Tsung Huang, Kaohsiung (TW); Shih-Chi Lai, Miaoli County (TW)

(73) Assignee: AUDEN TECHNO CORP., Taoyuan County (TW)

( * ) Notice: Subject to any disclaimer, the term of this patent is extended or adjusted under 35 U.S.C. 154(b) by 8 days.

(21) Appl. No.: 14/727,664

(22) Filed: Jun. 1, 2015

(51) Int. Cl.
*H01Q 1/24* (2006.01)
*H01Q 1/22* (2006.01)
*H01Q 13/10* (2006.01)

(52) U.S. Cl.
CPC ..... *H01Q 1/2266* (2013.01); *H01Q 1/24* (2013.01); *H01Q 1/243* (2013.01); *H01Q 13/10* (2013.01)

(58) Field of Classification Search
CPC .... H01Q 1/2266; H01Q 1/243; H01Q 13/10; H01Q 1/24
USPC ..... 343/702, 770
See application file for complete search history.

(56) References Cited

U.S. PATENT DOCUMENTS 6,373,443 B1 * 4/2002 Tsai ..... H01Q 1/085 343/702
7,034,762 B2 * 4/2006 Huang ..... G06F 1/1626 343/702
8,441,399 B2 * 5/2013 Wu ..... H01Q 1/2258 343/700 MS
8,823,596 B2 * 9/2014 Chen ..... H01Q 13/10 343/702

* cited by examiner

*Primary Examiner* — Brian Young
(74) *Attorney, Agent, or Firm* — Li & Cai Intellectual Property (USA) Office

(57) ABSTRACT

A communication device includes a housing and a first connector, an antenna module, and a feeding cable, which are disposed in the housing. The housing has a metal portion arranged on one side thereof, and the metal portion has a first hole and an elongated slot. The position of the first connector corresponds to the first hole. The antenna module has an insulating base and a monopole antenna disposed on the base. The base is fixed on the first connector and arranged adjacent to the slot, so part of the base exposes from the slot. The position of the monopole antenna corresponds to the slot, and the length of the monopole antenna is smaller or identical to the length of the slot. The monopole antenna is configured to couple the metal portion by the slot. The feeding cable is electrically connected to the monopole antenna.

10 Claims, 6 Drawing Sheets

COMMUNICATION DEVICE

BACKGROUND OF THE INVENTION

1. Field of the Invention

The instant invention relates to a communication device; in particular, to a communication device having a slot antenna structure.

2. Description of Related Art

The conventional communication device (e.g., notebook or tablet PC) is provided with an antenna structure. The design of the antenna structure is limited to the other components of the communication device, so the antenna structure is always arranged in the remaining space. For example, the antenna structure is disposed on one side of the communication device. However, the housing of the communication device is often formed by metal, so the antenna structure is easily influenced to reduce the efficiency thereof by being arranged close to the housing.

To solve the abovementioned problem, the inventors strive via industrial experience and academic research to present the instant disclosure, which can effectively improve the problem as mentioned above.

SUMMARY OF THE INVENTION

The instant disclosure provides a communication device for effectively improving the problem generated from an antenna structure arranged adjacent to a metal housing.

The instant disclosure provides a communication device, comprising a housing, a first connector, an antenna module, and a feeding cable. The first connector, the antenna module, and the feeding cable are disposed in the housing. A side of the housing is a flat and elongated construction and defines a longitudinal direction. The housing has a metal portion arranged on the side thereof, and the metal portion has a first hole and an elongated slot both arranged along the longitudinal direction. The position of the first connector corresponds to the position of the first hole of the metal portion, thereby providing a mating connector to insert into the first connector via the first hole. The antenna module comprises an insulating base and a monopole antenna. The insulating base has a fixing portion and a carrying portion. The fixing portion of the insulating base is fixed on the first connector, and the carrying portion is arranged adjacent to the elongated slot of the metal portion, thus part of the carrying portion is exposed from the metal portion via the elongated slot. The position of the monopole antenna approximately corresponds to the position of the elongated slot of the metal portion, and a length of the monopole antenna in the longitudinal direction is identical to or smaller than a length of the elongated slot in the longitudinal direction, wherein the monopole antenna is electrically coupleable to the metal portion by the elongated slot. The feeding cable is structurally and electrically connected to the monopole antenna.

In summary, the communication device of the instant disclosure can keep the metal portion of the housing from influencing the efficiency of the antenna module, and the monopole antenna can electrically couple to the metal portion of the housing by forming an elongated slot on the metal portion, thereby utilizing metal portion.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

Please refer to FIGS. 1 through 5, which show a first embodiment of the instant disclosure. References are hereunder made to the detailed descriptions and appended drawings in connection with the instant invention. However, the appended drawings are merely shown for exemplary purposes, rather than being used to restrict the scope of the instant invention.

The instant embodiment provides a communication device 100, such as a tablet PC, a keyboard of a notebook, or the other device. The communication device 100 of the instant disclosure is a keyboard of a notebook for example, but the communication device 100 is not limited thereto.

Figure 1:
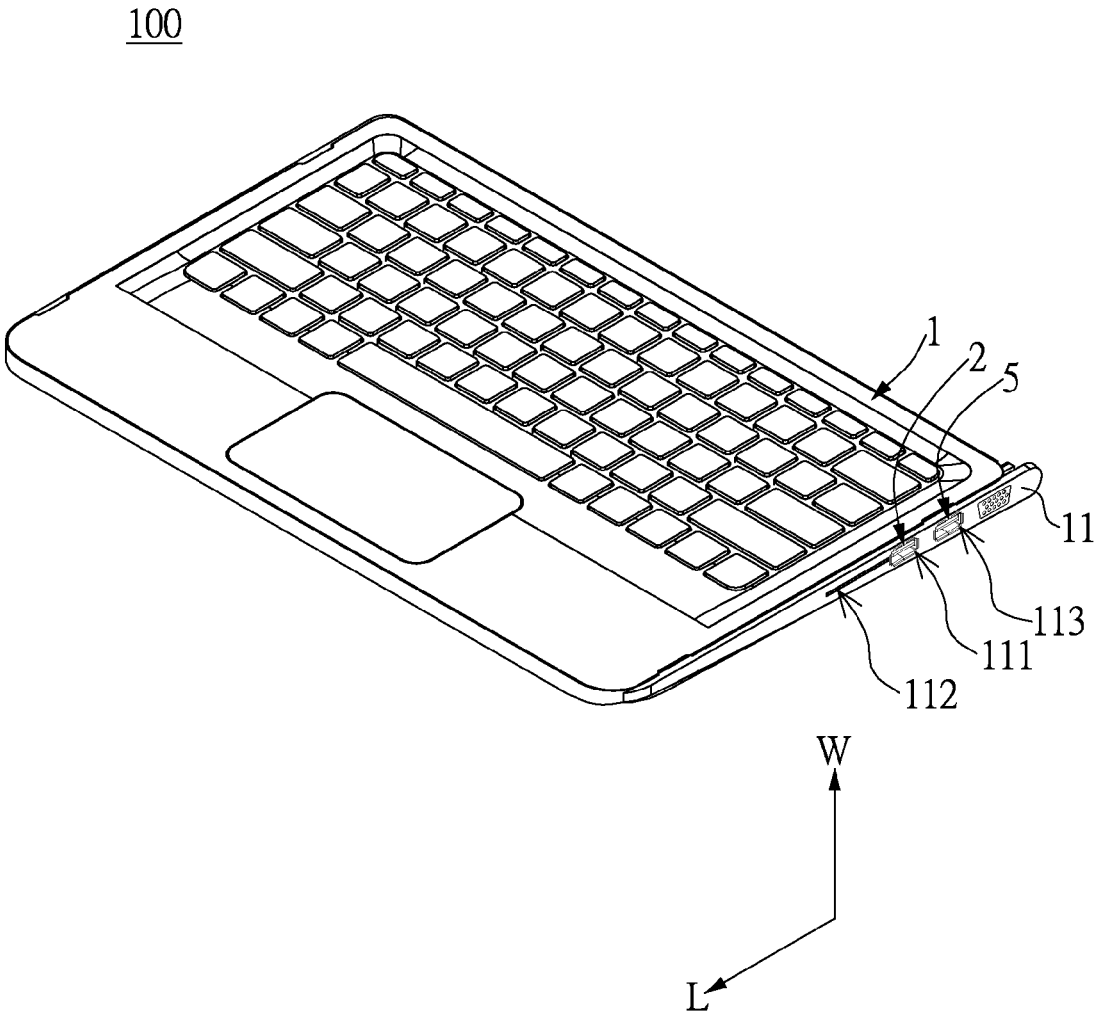
FIG. 1 is a perspective view showing a communication device according to the instant disclosure.
Figure 2:
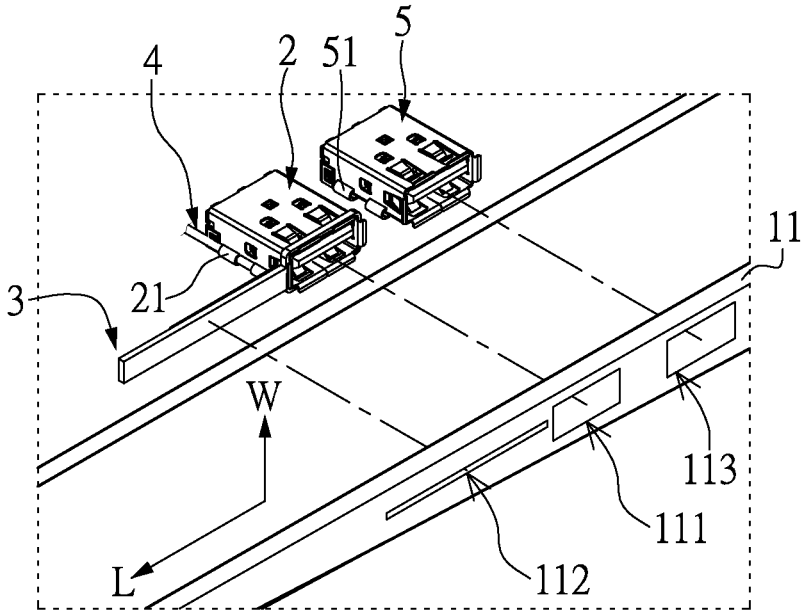
FIG. 2 is a perspective view showing part of the communication device in a first embodiment.
Figure 3:
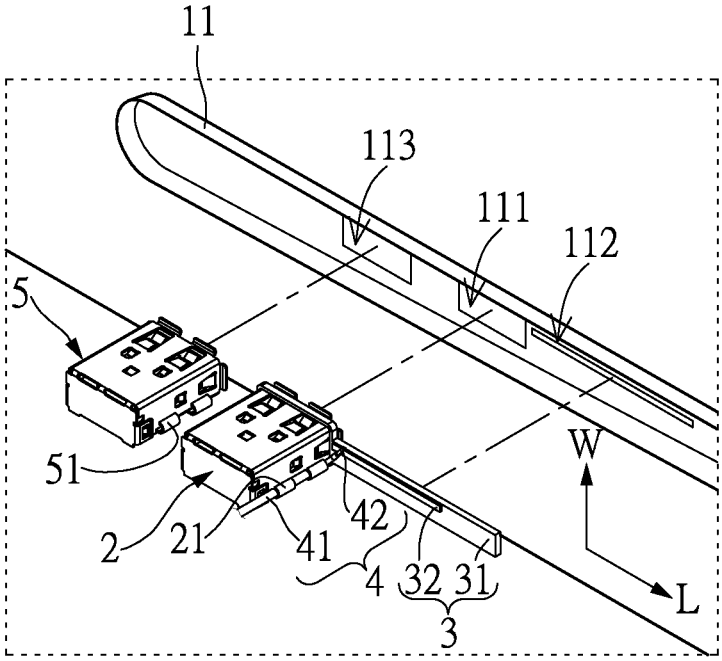
FIG. 3 is a perspective view of FIG. 2 from another perspective.
Figure 4:
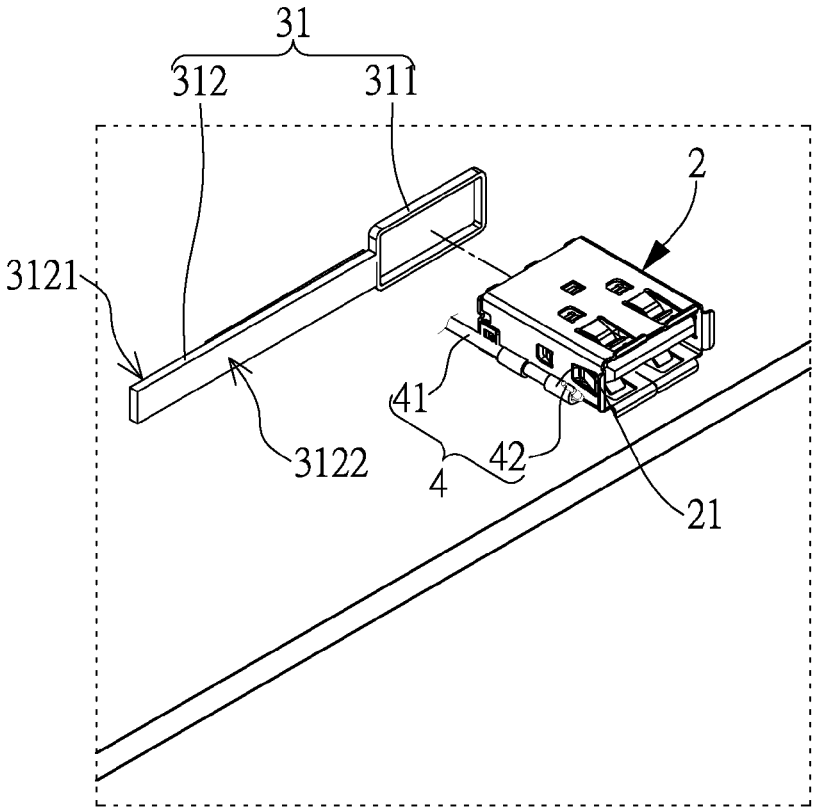
FIG. 4 is an exploded view of the first connector and the antenna module.
Figure 5:
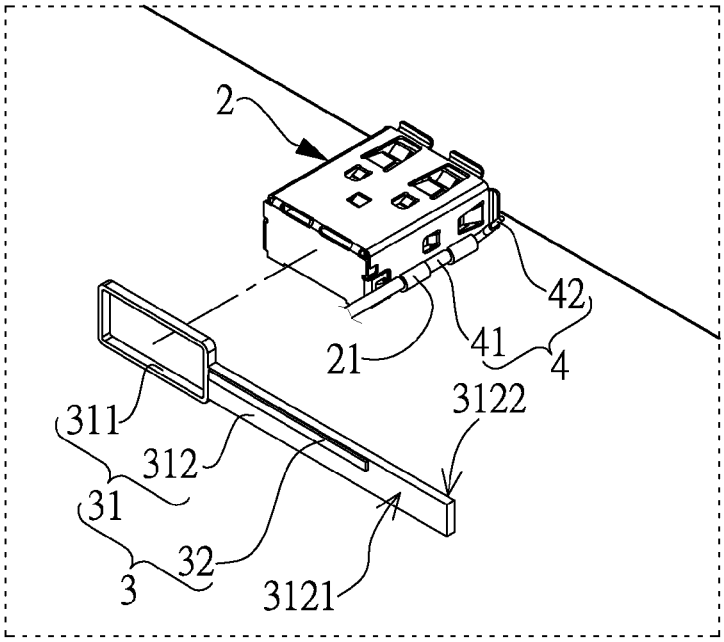
FIG. 5 is a perspective view of FIG. 4 from another perspective.

Please refer to FIGS. 1 through 3, in which FIGS. 2 and 3 only show part of the communication device 100 for easily explanation of the instant embodiment. The communication device 100 includes a housing 1, a first connector 2, an antenna module 3, and a feeding cable 4. The following description discloses part of the components of the communication device 100 (i.e., heat dissipating module 6), but some of the components of the communication device 100 (e.g., mother board or key pad) having low relation with respect to the instant embodiment are not disclosed.

One side of the housing 1 is a flat and elongated construction, the side of the housing 1 defines a longitudinal direction L and a transverse direction W perpendicular to the longitudinal direction L. The housing 1 includes an elongated metal portion 11 arranged on the side thereof. Specifically, the housing 1 in the instant embodiment is provided with the metal portion 11 arranged on the side thereof, but the housing 1 can be formed by metal. The metal portion 11 has a first hole 111 and an elongated slot 112 both arranged along the longitudinal direction L, the elongated slot 112 in the instant embodiment is substantially parallel to the longitudinal direction L, and a width of the elongated slot 112 in the transverse direction W is smaller than a width of the first hole 111 in the transverse direction W.

Additionally, the first hole 111 in the instant embodiment is arranged apart from the elongated slot 112 as shown in FIG. 2, but the first hole 111 can be formed in air communication with the elongated slot 112 in another embodiment.

The first connector 2 in the instant embodiment is a USB socket connector, but is not limited thereto. The position of the first connector 2 corresponds to the first hole 111 of the metal portion 11, that is to say, an opening end of the first connector 2 couples through the first hole 111, thereby a mating connector (not shown, such as a USB plug connector) can insert into the first connector 2 via the first hole 111.

Please refer to FIGS. 2 through 5. The antenna module 3 includes an insulating base 31 and a monopole antenna 32 disposed on the insulating base 31. One end of the feeding cable 4 is connected to the monopole antenna 32 for establishing an electrical connection of the feeding cable 4 and the monopole antenna 32. Another end of the feeding cable 4 is connected to a wireless communication module (not shown) of the communication device 100, thus the monopole antenna 32 of the antenna module 32 can be electrically connected to the wireless communication module by the feeding cable 4.

Moreover, the first connector 2 can be provided with at least one positioning portion 21 arranged on one side thereof. The feeding cable 4 has a braid sleeve 41 and a core wire 42 arranged in the braid sleeve 41. The core wire 42 is connected to the monopole antenna 32. The braid sleeve 41 is fixed on the positioning portion 21 for maintaining the relative position of the first connector 2 and the feeding cable 4, and the connection of the braid sleeve 41 and the positioning portion 21 has a grounding effect, so a welding process of the braid sleeve 41 can be omitted.

The insulating base 31 in the instant embodiment is approximately an elongated plate, and the insulating base 31 includes a fixing portion 311 and a carrying portion 312 integrally extended from the fixing portion 311. The fixing portion 311 of the insulating base 31 is fixed on the first connector 2. Specifically, the fixing portion 311 in the instant embodiment has a rectangular and annular shape, the inner edge of the fixing portion 311 conforms in shape to an outer edge of the first connector 2, and the first connector 2 couples through the fixing portion 311, thereby the insulating base 31 is fixed on the connector 2.

However, the first connector 2 in the instant embodiment is coupled through the fixing portion 311, but the shape of the fixing portion 311 is not limited to the annular shape. For example, the fixing portion 311 can be a C-shape (not shown) for buckling to the outer edge of the first connector 2.

The carrying portion 312 in the instant embodiment is a rectangular plate, and the carrying portion 312 is arranged adjacent to the elongated slot 112 of the metal portion 11, thus part of the carrying portion 312 is exposed from the metal portion 11 via the elongated slot 112. Specifically, the carrying portion 312 has an inner surface 3121 and an opposite outer surface 3122 facing the elongated slot 112 of the metal portion 11, and the inner surface 3121 is a surface of the carrying portion 312 arranged away from the elongated slot 112. The inner surface 3121 and the outer surface 3122 are substantially parallel to the outer surface of the metal portion 11, and part of the outer surface 3122 of the carrying portion 312 is exposed from the metal portion 11 via the elongated slot 112.

Moreover, the elongated slot 112 is arranged in a projecting region defined by orthogonally projecting the carrying portion 312 onto the metal portion 11. A length of the carrying portion 312 in the longitudinal direction L is greater than a length of the elongated slot 112 in the longitudinal direction L. A width of the carrying portion 312 in the transverse direction W is greater than a width of the elongated slot 112 in the transverse direction W, and is smaller than a height of the first connector 2 in the transverse direction W.

The monopole antenna 32 is disposed on the carrying portion 312 of the insulating base 31, and the monopole antenna 32 in the instant embodiment is adhered to the inner surface 3121 of the carrying portion 312. The position of the monopole antenna 32 approximately corresponds to the position of the elongated slot 112 of the metal portion 11, and a length of the monopole antenna 32 in the longitudinal direction L is smaller than a length of the elongated slot 112 in the longitudinal direction L. The monopole antenna 32 in the instant embodiment has a straight shape, but the shape of the monopole antenna 32 can be changed according to the designer's request. For example, the monopole antenna 32 can be an L-shape or T-shape (not shown).

Based on the above description, the monopole antenna 32 can electrically couple to the metal portion 11 by the elongated slot 112, such that the monopole antenna 32 and the metal portion 11 are cooperated to form as a slot antenna structure. Thus, the efficiency of the antenna module 3 is not influenced by the metal portion 11 of the housing 1, and the antenna module 3 can electrically couple to the metal portion 11 by the elongated slot 112 for further utilizing the metal portion 11 of the housing 1. Moreover, the antenna efficiency of the communication device 100 in the instant embodiment achieves a request of dual-band (e.g., 2.4 GHz/5 GHz) after testing.

The following description discloses the other possible embodiments of the communication device 100, but the communication device 100 is not limited thereto. The identical features of the following embodiments and the above embodiment as shown in FIG. 2 are not disclosed again, however the different features are disclosed as follows.

Figure 6:
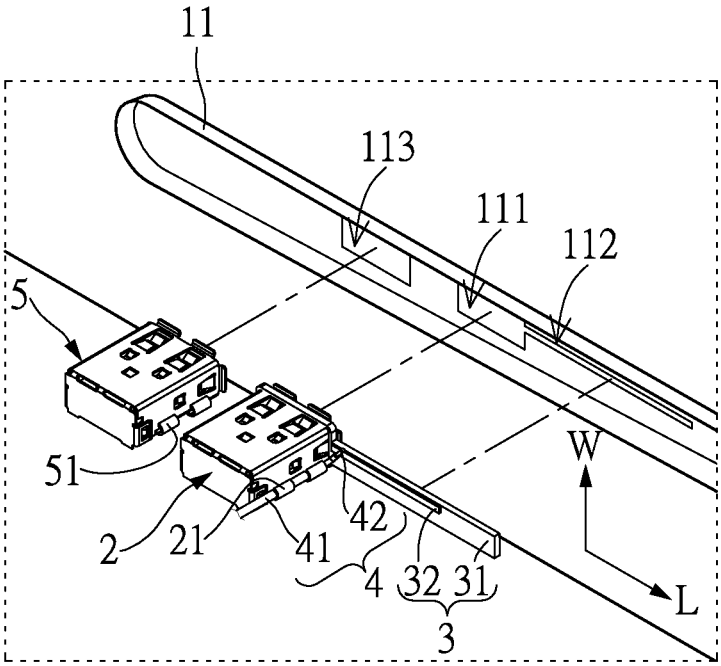
FIG. 6 is a perspective view showing part of the communication device in a second embodiment.

As shown in FIG. 6, the first hole 111 and the elongated slot 112 are in air communication with each other, and the monopole antenna 32 electrically couples to the metal portion 11 by the first hole 111 and the elongated slot 112, thereby the monopole antenna 32 and the metal portion 11 are cooperated to form as a slot antenna structure.

Figure 7:
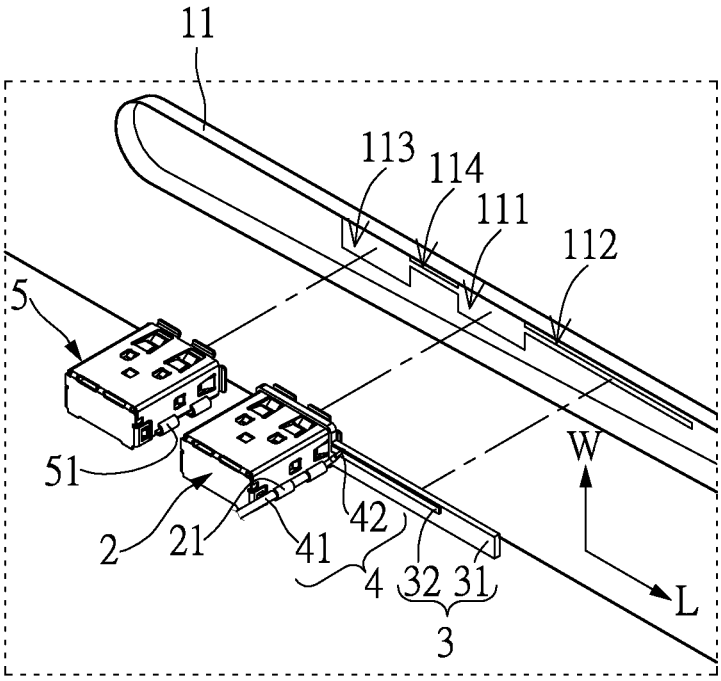
FIG. 7 is a perspective view showing part of the communication device in a third embodiment.

As shown in FIG. 7, the metal portion 11 has a second hole 113 arranged adjacent to the first hole 111, and the second hole 113 is in air communication with the first hole 113 by forming a slit 114. The communication device 100 further includes a second connector 5 (i.e., USB socket connector) arranged in the housing 1. The position of the second connector 5 corresponds to the position of the second hole 113 of the metal portion 11, that is to say, an opening end of the second connector 5 couples through the second hole 113, thereby a mating connector (not shown, such as a USB plug connector) can insert into the second connector 5 via the second hole 113. Moreover, the monopole antenna 32 electrically couples to the metal portion 11 by the first hole 111, the second hole 113, the elongated slot 112, and the slit 114, thereby the monopole antenna 32 and the metal portion 11 are cooperated to form as a slot antenna structure.

Figure 8:
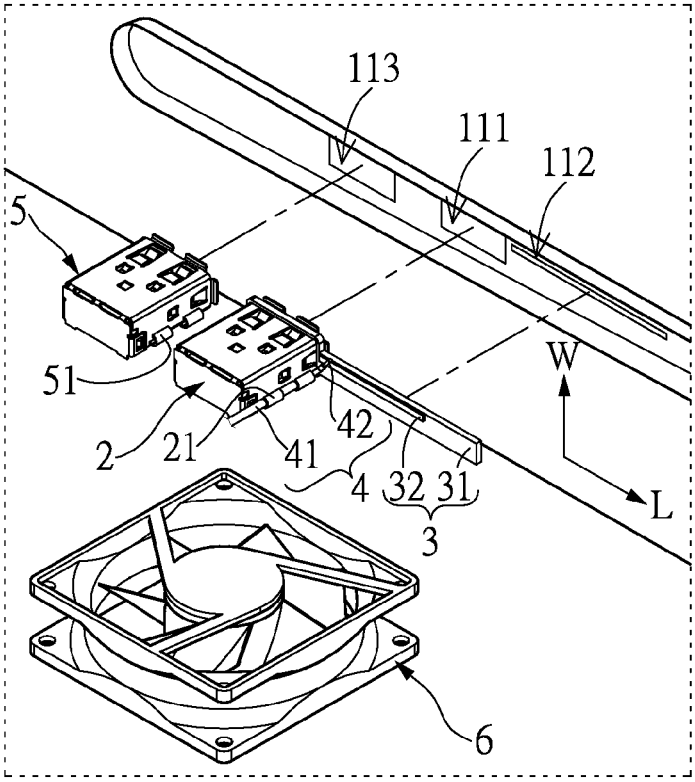
FIG. 8 is a perspective view showing part of the communication device in a fourth embodiment.

As shown in FIG. 8, the communication device 100 further includes a heat dissipating module 6, such as: fan, heat pipe, or the other component. The position of the elongated slot 112 corresponds to the position of the heat dissipating module 6 for dissipating heat. In other words, the housing 1 of the communication device 100 is often provided with an elongated heat dissipating hole arranged corresponding to the heat dissipating module 6, and the instant embodiment takes the heat dissipating hole to be a medium for helping the monopole antenna 32 to electrically couple to the metal portion 11.

Figure 9:
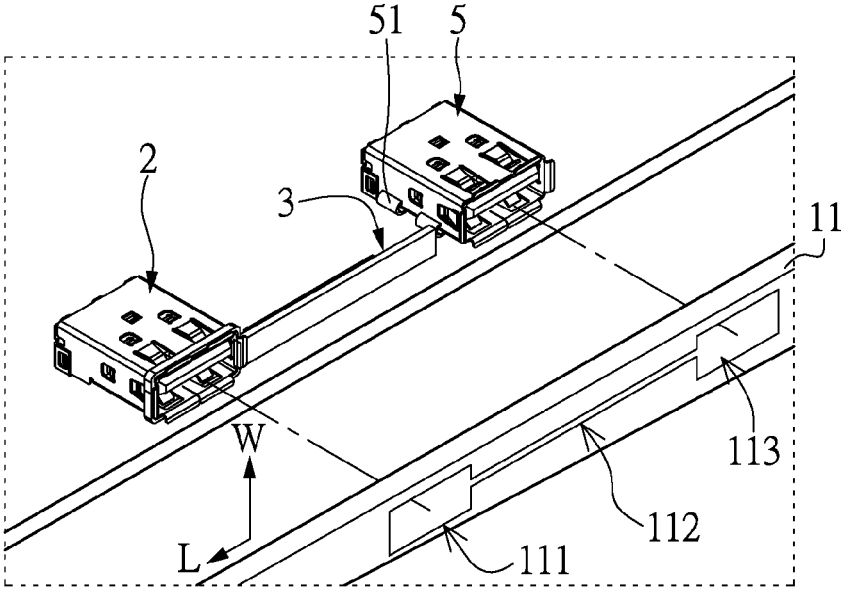
FIG. 9 is a perspective view showing part of the communication device in a fifth embodiment.
Figure 10:
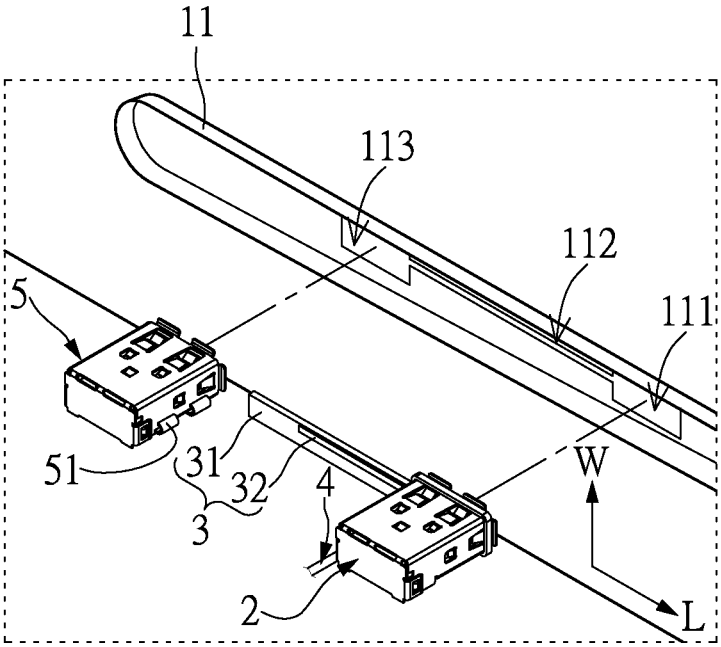
FIG. 10 is a perspective view of FIG. 9 from another perspective.

As shown in FIGS. 9 and 10, the metal portion 11 has a second hole 113 arranged adjacent to the first hole 111, the elongated slot 112 is arranged between the first hole 111 and the second hole 113, and two opposite ends of the elongated slot 112 are respectively in air communication with the first hole 111 and the second hole 113. The communication device 100 further includes a second connector 5 (i.e., a USB socket connector) arranged in the housing 1. The position of the second connector 5 corresponds to the position of the second hole 113 of the metal portion 11, that is to say, an opening end of the second connector 5 couples through the second hole 113, thereby a mating connector (not shown, such as a USB plug connector) can insert into the second connector 5 via the second hole 113.

Moreover, the carrying portion 312 of the insulating base 31 is arranged between the first connector 2 and the second connector 5, the length of the monopole antenna 32 in the longitudinal direction L is smaller than a length of the elongated slot 112, the first hole 111, and the second hole 113 in the longitudinal direction L. The monopole antenna 32 electrically couples to the metal portion 11 by the first hole 111, the second hole 113, and the elongated slot 112, thereby the monopole antenna 32 and the metal portion 11 are cooperated to form as a slot antenna structure.

Additionally, the positioning portion 21 of the first connector 2 is arranged close to the second connector 5 (not shown in FIG. 9, the positioning portion 21 is arranged on the right side of the connector 2), this braid sleeve 41 can be fixed on the positioning portion 21 for maintaining the relative position of the first connector 2 and the feeding cable 4, and the connection of the braid sleeve 41 and the positioning portion 21 has a grounding effect, so a welding process of the braid sleeve 41 can be omitted. Besides, the second connector 5 can be provided with at least one positioning portion 51, but is not limited thereto.

In each embodiment as shown in FIG. 2 and FIGS. 6 through 10, the length of the monopole antenna 32 in the longitudinal direction L must be smaller than or identical to the length of the elongated slot 112 in the longitudinal direction L. Moreover, except the embodiment as shown in FIG. 8, the elongated slot 112 can be filled with an insulating member for having a smooth outer surface.

In summary, the communication device of the instant disclosure can keep the metal portion of the housing from influencing the efficiency of the antenna module, and the monopole antenna can electrically couple to the metal portion of the housing by forming the elongated slot on the metal portion, thereby utilizing the metal portion.

Moreover, the instant disclosure can make the first or/and second holes communicate with the elongated slot for adjusting the size of hole, which helps the monopole antenna to electrically couple to the metal portion. In addition, the instant embodiment takes the heat dissipating hole to be a medium for helping the monopole antenna to electrically couple to the metal portion, thus the housing can be provided without any processing.

Additionally, the first connector (or the second connector) can be provided with a positioning portion arranged on one side thereof, and a grounding effect can be achieved by the connection of the braid sleeve and the positioning portion, so a welding process of the braid sleeve can be omitted.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. A communication device, comprising:

a housing, wherein a side of the housing is a flat and elongated construction and defines a longitudinal direction, the housing has a metal portion arranged on the side thereof, and the metal portion has a first hole and an elongated slot both arranged along the longitudinal direction;

a first connector disposed in the housing, wherein the position of the first connector corresponds to the position of the first hole of the metal portion, thereby providing a mating connector to insert into the first connector via the first hole;

an antenna module disposed in the housing, comprising:

an insulating base having a fixing portion and a carrying portion, wherein the fixing portion of the insulating base is fixed on the first connector; and the carrying portion is arranged adjacent to the elongated slot of the metal portion, thus part of the carrying portion is exposed from the metal portion via the elongated slot; and a monopole antenna disposed on the carrying portion of the insulating base, wherein the position of the monopole antenna approximately corresponds to the position of the elongated slot of the metal portion, and a length of the monopole antenna in the longitudinal direction is identical to or smaller than a length of the elongated slot in the longitudinal direction, wherein the monopole antenna is electrically coupleable to the metal portion by the elongated slot; and a feeding cable disposed in the housing, wherein the feeding cable is structurally and electrically connected to the monopole antenna.

2. The communication device as claimed in claim 1, wherein the carrying portion has an inner surface and an outer surface, the monopole antenna is disposed on the inner surface of the carrying portion, and the outer surface of the carrying portion faces the elongated slot of the metal portion.

3. The communication device as claimed in claim 2, wherein the carrying portion is a plate, the inner surface and the outer surface of the carrying portion are substantially parallel to an outer surface of the metal portion, and the monopole antenna is adhered to the inner surface of the carrying portion.

4. The communication device as claimed in claim 2, wherein the elongated hole is approximately parallel to the longitudinal direction, the housing defines a transverse direction perpendicular to the longitudinal direction, a width of the elongated slot in the transverse direction is smaller than a width of the first hole in the transverse direction; the first connector has a positioning portion, the feeding cable has a braid sleeve and a core wire arranged in the braid sleeve, wherein the core wire is connected to the monopole antenna, the braid sleeve is fixed on the positioning portion to establish a grounding function.

5. The communication device as claimed in claim 2, wherein the elongated slot is arranged in a projecting region defined by orthogonally projecting the carrying portion onto the metal portion.

6. The communication device as claimed in claim 5, wherein the first hole and the elongated slot are in air communication with each other, and the monopole antenna electrically couples to the metal portion by the first hole and the elongated slot.

7. The communication device as claimed in claim 5, wherein the metal portion has a second hole arranged adjacent to the first hole, the first hole is in air communication with the second hole and the elongated slot; the communication device comprises a second connector arranged in the housing, and the position of the second connector corresponds to the position of the second hole of the metal portion; wherein the monopole antenna electrically couples to the metal portion by the first hole, the second hole, and the elongated slot.

8. The communication device as claimed in claim 7, wherein the elongated slot is arranged between the first hole and the second hole, the first hole is in air communication with the second hole via the elongated slot; the carrying portion of the insulating base is arranged between the first connector and the second connector, the length of the monopole antenna in the longitudinal direction is smaller than a length of the elongated slot, the first hole, and the second hole in the longitudinal direction.

9. The communication device as claimed in claim 1, wherein the fixing portion has an annular shape, the first connector couples through the fixing portion, thereby the insulating base is fixed on the first connector.

10. The communication device as claimed in claim 1, further comprising a heat dissipating module disposed in the housing, wherein the position of the elongated slot corresponds to the position of the heat dissipating module for dissipating heat.

* * * * *